US006240559B1

(12) United States Patent
Cares

(10) Patent No.: US 6,240,559 B1
(45) Date of Patent: Jun. 5, 2001

(54) GARMENT COLLAR FORMER

(75) Inventor: Paul Cares, Alto, MI (US)

(73) Assignee: P & L Company, Kentwood, MI (US)

( * ) Notice: Subject to any disclaimer, the term of this patent is extended or adjusted under 35 U.S.C. 154(b) by 0 days.

(21) Appl. No.: 09/421,058

(22) Filed: Oct. 19, 1999

(51) Int. Cl.[7] ..... D06C 15/00
(52) U.S. Cl. ..... 2/52.1; 2/61
(58) Field of Search ..... 223/52.1, 61, 74, 223/77, 52, 1

(56) References Cited

U.S. PATENT DOCUMENTS

| | | | | |
|---|---|---|---|---|
| 904,398 | * | 11/1908 | Bartholemew | 223/61 |
| 952,674 | | 3/1910 | Kriesel . | |
| 1,228,466 | | 6/1917 | Mohn . | |
| 1,257,685 | | 2/1918 | Ehrmann . | |
| 1,980,845 | | 11/1934 | Beattie . | |
| 2,110,657 | * | 3/1938 | Berg | 223/61 |
| 2,684,190 | * | 7/1954 | Glover, Jr. | 223/61 |
| 3,471,068 | * | 10/1969 | Foreman | 223/61 |
| 3,901,420 | | 8/1975 | Revuelta . | |

* cited by examiner

*Primary Examiner*—Bibhu Mohanty

(74) *Attorney, Agent, or Firm*—Reising, Ethington, Barnes, Kisselle, Learman & McCulloch, P.C.

(57) ABSTRACT

A collar former (10) for use in finishing garment collars (24) as a part of laundering of the garments (22). The collar former (10) includes a split-cone section (12), base section (14), and a control mechanism (16). The split-cone section (12) includes two partially conical support members (18, 20) that are pivotally connected together at their smaller axial ends to form an axially-split conical support structure (42). The support members are outwardly biased from each other by a spring (28). Heating pads (38, 40) are mounted on the inside surfaces of the support members (18, 20), respectively, to supply heat to their outer surfaces. The control mechanism (16) includes a foot pedal (68), lever (70), pulley (74), and cable (76). Downward actuation of the foot pedal (68) is transferred via the cable (76) to the first support member (18) to move it toward the other support member (20) against the outward bias provided by spring (28). In use, the foot pedal is depressed, thereby pulling the support members (18, 20) together. Then, a dress shirt or other collared garment (22) is placed over the support members such that the garment is supported by engagement of its collar (24) with the conical support structure (42). The foot pedal (68) is then released with the bias from the spring (28) providing a circumferentially-expansive force on the collar (24). During this operation, heat is applied from the heating pads (38, 40) to dry the collar and garment while preserving the desired, pressed finished form of the collar.

27 Claims, 2 Drawing Sheets

2
44
12
38
26
40
52
10
54
42
24
20
28
64
18
74
76
46
56
14
22
60
58
16
78
68
70
66
62
2

GARMENT COLLAR FORMER

TECHNICAL FIELD

This invention relates generally to apparatus and methods for use in commercial laundering of dress shirts and other collared garments and, in particular, relates to apparatus and methods that are used following the washing and pressing of such garments to dry and preserve the pressed, finished form of the garments' collars.

BACKGROUND OF THE INVENTION

One of the more difficult operations in the commercial laundering of dress shirts and other such garments is the pressing and preserving of the garment's collar. Typically, these collars are pressed by a pressing machine after washing and prior to pressing of the remaining portions of the garment. Various such pressing machines have been proposed over the years. For example, U.S. Pat. No. 3,901,420, issued Aug. 26, 1975 to A. L. Revuelta, discloses a collar ironing machine having a pair of heated dies and a pair of flexible bands which are used to press a garment collar flat against the dies. One of the bands wraps over the dies with the other band being used to press the garment collar against the first band and the dies. The dies are secured onto respective levers which pivot to move the dies away from each other to thereby tautly press the collar between the two bands.

Another technique for pressing garment collars through the simultaneous application of pressure and heat is disclosed in U.S. Pat. No. 1,228,466, issued Jun. 5, 1917 to H. P. Mohn. This patent discloses a collar press which utilizes a shaper that is placed into the collar and an outer compression band that is placed around the outer surface of the collar. The compression band has two ends that are drawn together to press the outer fold of the collar against the shaper and the inner fold of the collar against a circular heated core member. Tightening of the band is accomplished using a foot pedal that is linked to the ends of the band by a chain that extends over sheaves that are journaled on a shaft. Downward movement of the foot pedal pulls the chains downward, thereby tightening the band about the collar.

U.S. Pat. No. 952,674 issued Mar. 22, 1910 to G. F. Kriesel discloses an apparatus which burnishes a collar through the use of a feed roller, burnishing iron, and shaper member. The collar is placed over the shaper such that the top fold of the collar contacts the burnishing iron. The feed roller is driven by a motor through a pulley system and operates to press and feed the collar against the shaper while the top fold of the collar is pulled along the burnishing iron.

Yet another technique for pressing garment collars is disclosed in U.S. Pat. No. 1,257,685 issued Feb. 26, 1918 to G. B. Ehrmann. This patent discloses a collar pressing apparatus which uses a concave support bed and complementary pressing member to press a wing-collar. Each end of the wing-collar is inserted onto the concave surface of the bed, after which the cooperating top pressing member is brought down to press the wing-collar. The concavity of the bed surface helps achieve the desired form and curve of the wing-collar.

Yet a further example of a machine for pressing garment collars is disclosed in U.S. Pat. No. 1,980,845, issued Nov. 13, 1934 to W. J. Beattie. This patent discloses a collar pressing machine having a vertically oriented, heated, hollow cone to support the collar while it is being ironed. The cone has a frusto-conical shape and is oriented vertically such that the cone taper is downwardly divergent. This permits a dress shirt or other collared garment to be placed over the upper, convergent end of the cone and then pulled downwardly toward the larger end of the cone until reaching a point at which a snug fit of the collar is obtained. The collar pressing machine includes an ironing tool that swings around the circular circumference of the cone to permit the collar to be pressed against the heated cone surface. One disadvantage of this collar pressing machine is that it can significantly slow the collar pressing process since the ironing tool is typically detached to permit insertion and removal of each shirt and, once re-attached, may need to be adjusted in length depending upon the vertical location of the collar on the cone. Also, the shirt collar must be positioned angularly on the cone such that the collar button fits within a vertical grove out of the way of the ironing tool. These steps can add time and difficulty to the processing of collars and can therefore slow down the throughput of a commercial laundry operation. Consequently, this type of collar pressing machine has not become widely adopted.

It is common practice within the laundering industry to press dress shirts and similar collared garments while they are still damp from the laundering process. While this damp condition is of benefit in the pressing operation, the garments must preferably be further dried prior to boxing them or placing them on hangers. Often, this drying step is accomplished using a hollow cone such as described in the above-noted Beattie patent, but without the ironing tool. The collar is buttoned and the garment pulled down over the upper, convergent end of the cone until there is a snug fit of the collar on the surface of the cone. The cone is heated using an internal lamp and this heat transfers to the garment collar, evaporating the remaining moisture contained in the collar. These drying cone arrangements rely on the intrinsic elasticity in the collar and stitching for the pressure exerted between the cone and collar and, as a result, do not provide sufficient pressure on the collar to provide a good, sharp finished form. These drying cones also can be undesirably cumbersome for loading and unloading of the garment since it must be pulled down with force onto the cone to achieve a snug fit of the collar and then must be pulled back up with suitable force to remove the collar.

Thus, it would be advantageous to provide a collar forming apparatus that is capable of concurrently applying adequate pressure and heat to garment collars to provide a desirable finish to the collars and that is capable of rapid garment transfer, thereby satisfying commercial quality and throughput requirements.

SUMMARY OF THE INVENTION

The above-noted shortcomings of prior art collar forming devices are overcome by the present invention which in one aspect comprises a collar former having at least two support members and a control mechanism coupled to at least a first one of the support members to control movement of the first support member relative to a second one of the support members. The first support member moves relative to the second support member from a first position to a second position. One or both of the first and second support members have a divergent portion which includes an outer, collar support surface that moves relative to the other of said first and second support members in a direction toward the other support member when the first support member is moved from the first position to the second position. The control mechanism has a control element that is coupled to the first support member and that is movable between two positions under operator control. This control element controls the position of the first support member relative to the second support member with the first support member being at the first position when the control element is placed in one of the two positions and the first support member being at the second position when the control element is placed in the other of the two positions.

Preferably, the collar former comprises a split-cone section, heat source, base section, and a control mechanism. In this more preferred embodiment of the invention, the split-cone section includes two partially conical support members, each of which has two axial ends, an inner surface, and an outer, collar support surface. The support members are pivotally connected together at the smaller of their axial ends to form an axially-split conical support structure, with the support members being outwardly biased from each other such that, in the absence of an external force overcoming the bias, the support members are horizontally spaced apart at the larger of the axial ends. The base section is attached to the split-cone section to support the split-cone section in a generally vertical, downwardly diverging orientation. The base section includes an elongated stand and a lower base support. The elongated stand has two ends and is rigidly connected at an upper one of its ends to one of the support members and at a lower one of its ends to the lower base support. The heat source is thermally coupled to the support members to supply heat to the collar support surface for heating of a garment collar located thereon. The control mechanism includes a lever, foot pedal, and cable. The lever is pivotally attached at the lower end of the elongated stand and has the foot pedal attached to it at one end. The lever is connected via the cable to a first one of the support members such that downward actuation of the foot pedal is transferred via the cable to the first support member to move it toward the other support member against the outward bias.

In accordance with another aspect of the invention, there is provided a method for finishing garment collars as a part of laundering of the garments. The method includes the steps of: (a) providing a plurality of support members that together define an axially-split support structure; (b) placing a collared garment over the plurality of support members such that the garment is supported by engagement of the collar with the support structure; (c) moving at least one of the support members in a direction away from at least one other of the support members to thereby apply a circumferentially-expansive force on the collar; and (d) heating the collar while the circumferentially-expansive force is applied to the collar. Preferably, the circumferentially-expansive force is obtained by biasing a first one of the support members away from a second one of the support members during at least steps (c) and (d). Also, in a more preferred embodiment, the first support member is biased away from the second support member even during step (b) with a foot pedal being used to move the support members together in opposition to the biasing force during loading and unloading of a garment collar onto the support members.

The collar former method and apparatus of the present invention provides an improved finished form to the garment collar, while additionally easing the task of garment transfer to and from the device. After washing and pressing of the garment and collar, the invention can be used to uniformly apply a radially-outward pressure on the collar and this pressure can be accompanied by heating of the collar for final drying of the collar and remainder of the garment. For dress shirts especially, this provides a sharply folded, pressed finish to the garment collar that has an improved appearance and feel over that produced by conventional machines and methods. Furthermore, by providing a foot operated mechanism for control of the collar forming machine, the operator's hands remain free for loading and unloading of the garment on the machine, thereby increasing the efficiency and speed of garment transfer to and from the machine.

BRIEF DESCRIPTION OF THE DRAWINGS

A preferred exemplary embodiment of the present invention will hereinafter be described in conjunction with the appended drawings, wherein like designations denote like elements, and.

DETAILED DESCRIPTION OF THE PREFERRED EMBODIMENT

Figure 1:
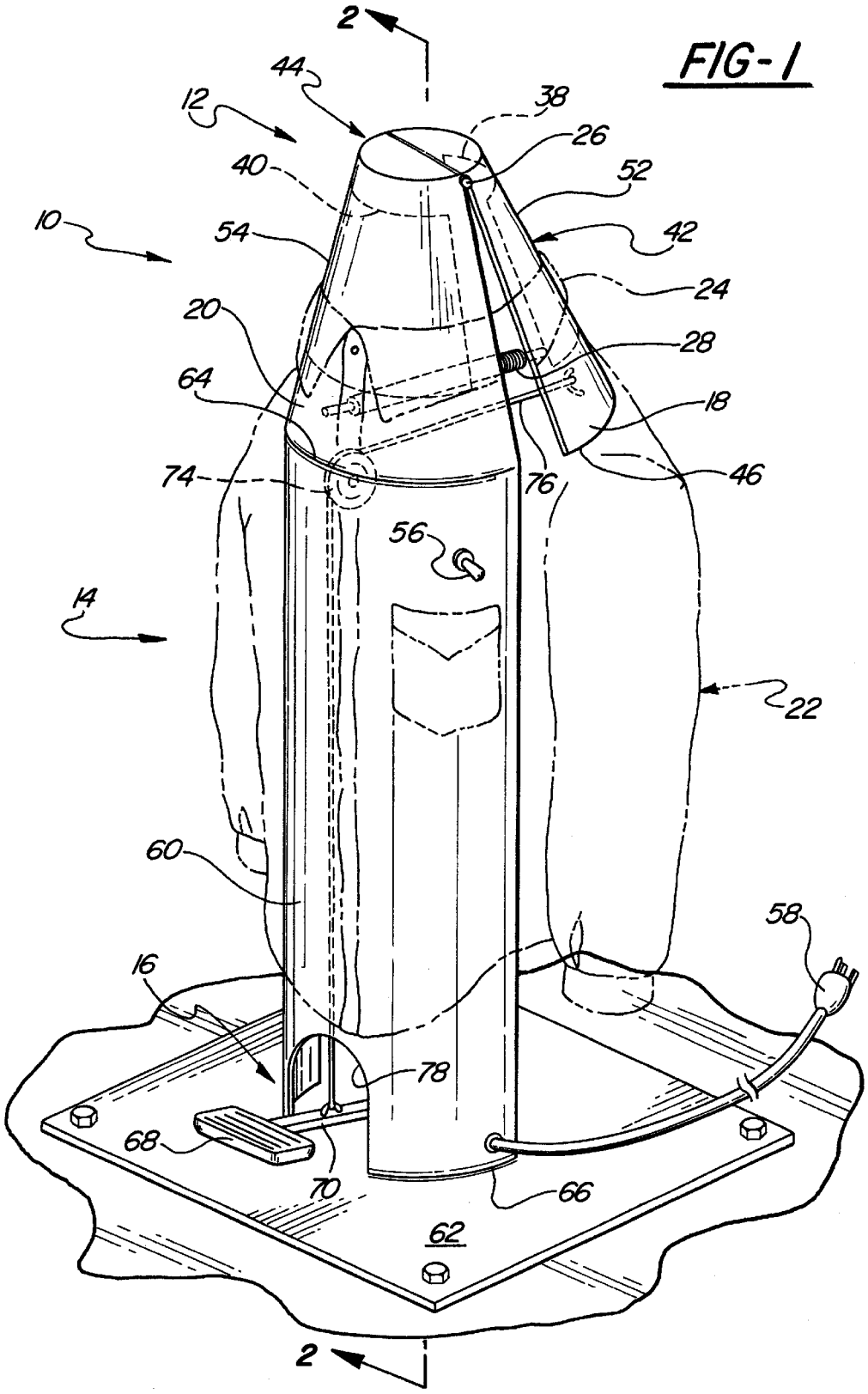
FIG. 1 is a perspective view of a preferred embodiment of a collar forming device of the present invention, showing a garment loaded thereon.

With reference to the FIG. 1, there is shown a collar former 10 which in general includes a split-cone section 12, a base section 14, and a control mechanism 16. The split-cone section 12 is primarily comprised of two partially conical, metal support members 18, 20 and is supported and stabilized by base section 14. These support members are hingedly connected at their upper end and are outwardly biased away from each other so that they pivotally open at their lower end due to the biasing force and may be pivotally closed together by operation of control mechanism 16. In general, collar former 10 is operated as follows. Control mechanism 16 is actuated by applying downward foot pressure to draw the two support members 18, 20 together. Then, a garment 22 is pulled over top of the split-cone section 12 such that the inner surface of the garment's collar 24 circumferentially contacts the support members. Control mechanism 16 is then released and the support members hinge apart due to the outward bias on them. As the support members separate, pressure and heat are simultaneously applied to collar 24 to thereby heat and dry the collar into a tightly folded, well finished final form.

Figure 2:
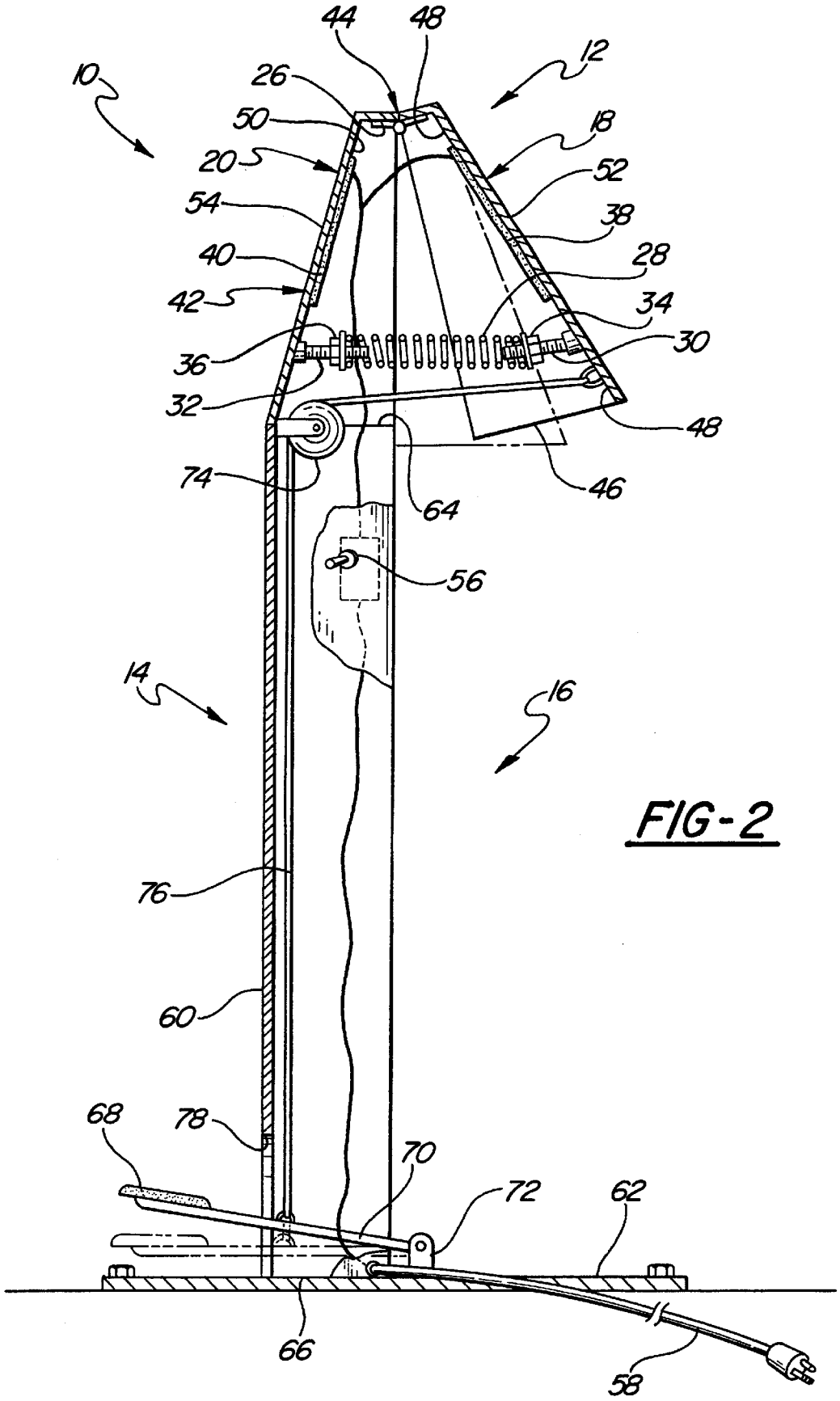
FIG. 2 is a partial cross-sectional view of the collar forming device of FIG. 1.

Referring now also to FIG. 2, split-cone section 12 comprises support members 18, 20, a hinge 26, a spring 28, two threaded rods 30, 32, two nut/washer pairs 34, 36, and two heating elements 38, 40. Support members 18, 20 together define a hollow, axially-split conical support structure 42. These support members are complementary in shape and are pivotally connected at their smaller axial end 44 by hinge 26. The second support member 20 is rigidly connected to base section 14 at its larger axial end 46, leaving the first support member 18 movable and free to pivot about hinge 26. Spring 28 is coupled to the respective inner surfaces 48, 50 of support members 18, 20 via the threaded rods 30, 32 and nut/washer pairs 34, 36. This spring is used to exert an outward bias that acts to spread the two support members apart at their lower axial ends 46. The threaded rods 30, 32 extend towards each other from the inner surfaces 48, 50 of support members 18, 20, respectively. Spring 28 extends between the two rods and coaxially over the inwardly located ends of each of the rods. Spring 28 is retained in place and held in compression by the nut/washer pairs 34, 36 which are threaded onto their respective rods 30, 32. As will be appreciated, the nut/washer pairs 34, 36 can be adjusted along the lengths of their respective rods to thereby adjust the magnitude of the biasing force provided by spring 28 when the support members 18, 20 are closed together using control mechanism 16.

The respective outer surfaces 52, 54 of support members 18, 20 each comprise a collar support surface that physically contacts the inner surface of collar 24 when garment 22 is mounted on collar former 10. First collar support surface 52 is located on first support member 18 and is therefore movable in relation to second collar support surface 54 which is located on stationary second support member 20. Preferably, these collar support surfaces are downwardly-divergent, as shown, and are designed to accommodate 14" to 22" collars. For this purpose, when closed (i.e., when support member 18 is drawn into a closed position against support member 20), the conical support structure 42 can have a diameter of approximately 3.5" at its smaller axial end 44 and a diameter of approximately 7.5" at its larger axial end 46.

Heating elements 38, 40 comprise electrically-operable heating pads that are mounted on the respective inner surfaces 48, 50 of support members 18, 20. The heating pads 38, 40 are wired to a toggle switch 56 which can be used by an operator to switch operating power to the heating pads 38, 40. Switch 56 is wired down through the base section 14 to a standard three pronged plug 58, with the base section being grounded via the ground pin on plug 58. Although switch 56 is shown mounted on the upper, exterior surface of base section 14, it will be appreciated that it can be mounted at other locations such as, for example, the interior surface of base section 14.

Base section 14 primarily comprises an elongated metal stand 60 and a lower base support 62. Stand 60 is a partially tubular member that acts as both a support for the axially-split conical support structure 42 and as an easily accessible housing for control mechanism 16 and the wiring used for providing electrical power to heating pads 38, 40. Stand 60 has a generally C-shaped cross-section and is welded or otherwise integrally attached to the second support member 20 at its upper end 64 and to lower base support 62 at its lower end 66. The height of stand 60 is generally designed to accommodate an operator's desired work height. Lower base support 62 is a flat metal plate that is used to stabilize collar former 10 and, if desired, base support 62 can be bolted down to prevent collar former 10 from moving or tipping over. Base section 14 therefore supports the axially-split conical support structure 42 in a generally vertical, downwardly diverging orientation that permits easy loading and unloading of garments at a height that is convenient for the operator.

Control mechanism 16 comprises a foot pedal 68, lever 70, clevis 72, pulley 74, and a cable 76 that connects lever 70 to the first support member 18 via pulley 74. In particular, cable 76 is attached at one end to lever 70 near its midpoint and extends vertically upward, over pulley 74, and then horizontally to support member 18, with the other end of cable 76 being attached to the inner surface 48 of support member 18 near its lower axial end 46. Lever 70 is pivotally mounted at one end to clevis 72 which is integrally attached to base support 62 at the rear (open) side of stand 60. Lever 70 extends outwardly through an arched opening 78 located at the lower end 66 of stand 60 such that the other end of lever 70 is located at an exposed, forward location relative to stand 60. Foot pedal 68 is attached to this other end of lever 70 and is used as a control element for control of the relative positioning of support members 18, 20. Pulley 74 is rotatably mounted to the interior surface of stand 60 near its upper end 64 and is used as a transfer member to transfer the cable's vertical force from actuation of foot pedal 68 into a horizontal force that draws support member 18 inwardly against the bias provided by spring 28.

As will be appreciated, in the absence of downward pressure being applied by the operator on foot pedal 68, support member 18 will be outwardly biased to the first position shown in FIG. 2. This will in turn locate the foot pedal at the upper position shown in FIG. 2 due to the connection of lever 70 to the support member 18 via cable 76. In this way, spring 28 biases both the support member 18 and control mechanism 16 into their initial (non-actuated) positions. Then, downward pressure by the operator on foot pedal 68 that is in excess of the biasing force provided by spring 28 will cause downward pivotal movement of lever 70 about the lever's pivot axis at clevis 72, with foot pedal 68 thereby moving to the lower position shown in phantom in FIG. 2. As a result, cable 76 will be pulled downward, with this vertically downward force being transferred by pulley 74 into a horizontal force which draws the lower axial end 48 of support member 18 toward support member 20, as shown in phantom. Consequently, control mechanism 16 permits foot operated control of collar former 10 in a manner that leaves the operator's hands free for loading and unloading of garments.

Preferably, collar former 10 is used for finishing dress shirt collars and other garment collars as a part of laundering the garments. It is utilized after the garment and garment collar has been washed and pressed and, preferably, before the garment has fully dried. In use, the garment collar is closed (whether by buttoning or otherwise) and the operator actuates foot pedal 68 to draw support members 18 and 20 together. While holding the foot pedal down, the garment 22 is placed over the support members 18, 20 such that the garment is supported by engagement of its collar 24 with the conical support structure 42. Then, the foot pedal is released and the biasing force provided by spring 28 moves the first support member 18 away from the second support member 20 to thereby apply a circumferentially-expansive force to the collar 24. As a result, the first support member 18 is held by the collar against the outward bias at a position intermediate the first support member's fully open and fully closed positions. This operative position of the collar former 10 is shown in FIG. 1. The circumferentially-expansive pressure is maintained on the collar 24 for a period of time to hold the collar in a tightly folded configuration while heat is applied to the collar using heating pads 38, 40. This heat dries the collar 24, thereby preserve the well finished form achieved through the expansive force. Once the collar and garment have sufficiently dried, the operator again actuates foot pedal 68 to remove the circumferentially-expansive force on collar 24 and then simply lifts the garment off the conical support structure 42. The cycle can then be repeated for the next garment. Preferably, heating pads 38, 40 are left switched on between cycles, although if desired, they can be switched on and off for each cycle.

Preferably, the support members comprise two partially conical support members that together define a downwardly-diverging, axially-split conical support structure, as shown in the illustrated embodiment. However, the support structure need not be downwardly-diverging, nor must it be made from only two support members. Rather, it can be made from three or more support members, with at least one of the support members being movable to provide the circumferentially-expansive force on the collar. Moreover, other support member arrangements could be utilized without departing from the scope of the invention. For example, the movable support member(s) need not pivot, but could move linearly or along a more complex path.

Similarly, control mechanisms other than that utilized in the illustrated embodiment can be used. For example, rather than a foot pedal, movement of the support members can be controlled using an hand-operated lever. Alternatively, instead of manual control of the support member(s), an electronically-actuated mechanism can be used.

Although heating pads 38, 40 are located on the inner surfaces 48, 50 of support members 18, 20, respectively, they supply heat to the outer collar support surfaces 52, 54, respectively, by conduction through the metal support members. Thus, they operate as heat sources that are thermally coupled to collar support surfaces. Also, as will be appreciated, internal or external heating sources other than heating pads 38, 40 can be used, with the heat for drying of the collar being provided by conduction (as in the illustrated embodiment) or by radiation and/or conduction (such as from a lamp within split cone section 12).

As should now be appreciated, the present invention offers several advantages. First, by applying a circumferentially-expansive pressure to the garment collar following pressing of the garment and collar, a preferred finish can be achieved for the collar. Second, heat can be simultaneously applied during application of the expansive force to help dry the collar in the more preferred finished form. The heat is also believed to be more efficiently transferred to the collar due to the outward pressure exerted by the heated support members, thereby resulting in faster drying of the collar and the garment itself. Also, it has been found that upper shirt buttons that crack during the pressing operation are more likely to break during use of the invention than with prior art drying cones. This permits detection and replacement of these cracked buttons before the garment is returned to the customer, thereby increasing customer satisfaction.

It will thus be apparent that there has been provided in accordance with the present invention a collar former which achieves the aims and advantages specified herein. It will, of course, be understood that the foregoing description is of a preferred exemplary embodiment of the invention and that the invention is not limited to the specific embodiment shown. Various changes and modifications will become apparent to those skilled in the art and all such changes and modifications are intended to be within the scope of the present invention.

I claim:

1. An apparatus for use in finishing garment collars as a part of laundering of the garments, comprising:

at least two support members located adjacent each other and disposed in a generally vertical orientation, a first one of said support members being movable in a generally horizontal direction relative to a second one of said support members from a first position to a second position, wherein at least one of said first and second support members has a partially conical, downwardly-diverging, collar support surface and wherein said collar support surface moves relative to the other of said first and second support members in a direction toward said other support member when said first support member is moved from said first position to said second position; and a control mechanism having a control element that is coupled to said first support member and that is movable between two positions under operator control, wherein said control element controls the position of said first support member relative to said second support member with said first support member being at said first position when said control element is placed in one of said two positions and said first support member being at said second position when said control element is placed in the other of said two positions.

2. An apparatus as defined in claim 1, wherein said first support member is outwardly biased toward said first position.

3. An apparatus as defined in claim 2, further comprising a spring coupled between said first and second support members, wherein said spring outwardly biases said first support member toward said first position.

4. An apparatus as defined in claim 2, wherein, in the absence of operator actuation of said control element, said control element is biased into said one position.

5. An apparatus as defined in claim 4, wherein, when in use, said control element can be actuated by the operator to move said control element to the other of said two positions to permit loading of a garment collar onto said support members and, upon release of said control element by the operator, said first support member is held by the collar against said outward bias at a position intermediate said first and second positions.

6. An apparatus as defined in claim 2, wherein said control mechanism is operable upon actuation of said control element to move said first support member toward said second support member against said bias.

7. An apparatus as defined in claim 1, further comprising a heat source thermally coupled to said collar support surface.

8. An apparatus for use in finishing garment collars as a part of laundering of the garments, comprising:

at least two support members, a first one of said support members being movable relative to a second one of said support members from a first position to a second position, wherein at least one of said first and second support members has a divergent portion that includes an outer, collar support surface and wherein said collar support surface moves relative to the other of said first and second support members in a direction toward said other support member when said first support member is moved from said first position to said second position;

a heat source thermally coupled to said collar support surface; and a control mechanism having a control element that is coupled to said first support member and that is movable between two positions under operator control, wherein said control element controls the position of said first support member relative to said second support member with said first support member being at said first position when said control element is placed in one of said two positions and said first support member being at said second position when said control element is placed in the other of said two positions;

wherein said first support member contains said collar support surface and further comprising a second heat source thermally coupled to an outer collar support surface of said second support member.

9. An apparatus as defined in claim 8, further comprising an electrical switch electrically coupled to said heat sources to permit operator control of said heat sources.

10. An apparatus as defined in claim 1, wherein said control element comprises a foot pedal.

11. An apparatus as defined in claim 10, further comprising a rigid base section having an elongated stand and a lower base support, said elongated stand having two ends and being rigidly connected at a first one of said ends to said second support member and at a second one of said ends to said lower base support.

12. An apparatus as defined in claim 11, wherein said control mechanism further comprises a lever, pulley, and cable, said lever having a free end and being pivotally mounted near said second end of said elongated stand with said foot pedal being connected to said free end of said lever, said pulley being rotatably connected near said first end of said elongated stand, said cable having two ends and being connected to said first support member at a first end and to said lever at a second end with said cable operably contacting said pulley in between said two ends, whereby actuation of said foot pedal causes movement of said first support member from said first position to said second position via said lever and said cable.

13. An apparatus for use in finishing garment collars as a part of laundering of the garments, comprising:

at least two support members, a first one of said support members being movable relative to a second one of said support members from a first position to a second position, wherein at least one of said first and second support members has a divergent portion that includes an outer, collar support surface and wherein said collar support surface moves relative to the other of said first and second support members in a direction toward said other support member when said first support member is moved from said first position to said second position; and a control mechanism having a control element that is coupled to said first support member and that is movable between two positions under operator control, wherein said control element controls the position of said first support member relative to said second support member with said first support member being at said first position when said control element is placed in one of said two positions and said first support member being at said second position when said control element is placed in the other of said two positions;

wherein said support members together form an axially-split conical support structure which extends from a smaller axial end to a larger axial end.

14. An apparatus as defined in claim 13, wherein said first support member is hingedly attached to said second support member at said smaller axial end.

15. An apparatus as defined in claim 13, wherein said first support member is outwardly biased toward said first position, whereby the larger axial end of said first support member is biased away from the larger axial end of said second support member.

16. An apparatus as defined in claim 13, wherein, when said first support member is in said second position, said smaller axial end has circumference of less than fourteen inches and said larger axial end has a circumference of greater than twenty-two inches.

17. An apparatus for use in finishing garment collars as a part of laundering of the garments, comprising:

at least two support members located adjacent each other and disposed in a generally vertical orientation, a first one of said support members being movable in a generally horizontal direction relative to a second one of said support members from a first position to a second position, said first one of said support members being movably biased towards said first position, wherein said first support member includes an outer, partially conical, downwardly-diverging, collar support surface, and wherein said collar support surface moves relative to said second support member in a direction toward said second support member when said first support member is moved against said bias from said first position to said second position;

a heat source thermally coupled to said collar support surface; and a control mechanism having a control element which is coupled to said first support member and is movable between two positions under operator control, wherein said control element controls the position of said first support member relative to said second support member with said first support member being at said first position when said control element is placed in one of said two positions and said first support member being at said second position when said control element is placed in the other of said two positions, whereby said control element is operable to move said first support member from said first position to said second position against said bias.

18. An apparatus as defined in claim 17, further comprising a spring coupled between said first and second support members, wherein said spring outwardly biases said first support member toward said first position.

19. An apparatus for use in finishing garment collars as a part of laundering of the garments, comprising:

at least two support members, a first one of said support members being movable relative to a second one of said support members from a first position to a second position, said first one of said support members being movably biased towards said first position, wherein said first support member includes an outer, collar support surface, and wherein said collar support surface moves relative to said second support member in a direction toward said second support member when said first support member is moved against said bias from said first position to said second position;

a heat source thermally coupled to said collar support surface; and a control mechanism having a control element which is coupled to said first support member and is movable between two positions under operator control, wherein said control element controls the position of said first support member relative to said second support member with said first support member being at said first position when said control element is placed in one of said two positions and said first support member being at said second position when said control element is placed in the other of said two positions, whereby said control element is operable to move said first support member from said first position to said second position against said bias;

wherein said support members together form an axially-split conical support structure which extends from a smaller axial end to a larger axial end.

20. An apparatus as defined in claim 17, further comprising an electrical switch electrically coupled to said heat source to permit operator control of said heat source.

21. A collar former comprising:

a split-cone section having at least two partially conical support members, each of which has two axial ends, an inner surface, and an outer, collar support surface, said support members being pivotally connected together at the smaller of said axial ends to form an axially-split conical support structure, said support members being outwardly biased from each other such that, in the absence of an external force overcoming said bias, said support members are horizontally spaced apart at the larger of said axial ends;

a base section attached to said split-cone section to support said axially-split conical support structure in a generally vertical, downwardly diverging orientation, said base section including an elongated stand and a lower base support, said elongated stand having two ends and being rigidly connected at an upper one of said ends to one of said support members and at a lower one of said ends to said lower base support;

at least one heat source thermally coupled to said support members; and a control mechanism comprising a lever, foot pedal, and cable, said lever having two ends and being pivotally attached near said lower end of said elongated stand, said foot pedal being attached to a first end of said lever, said lever being connected via said cable to a first one of said support members such that downward actuation of said foot pedal is transferred via said cable to said first support member to move it toward the other of said support members against said outward bias.

22. An apparatus as defined in claim 21, wherein said control mechanism further comprises a pulley, said cable being connected between said lever and said first support member with said cable extending vertically upwards from said lever, over said pulley, and then horizontally to said first support member, wherein downward movement of said foot pedal causes a downward force that is transferred by said pulley into a horizontal force that pulls the larger axial end of said first support member toward said second support member against said bias.

23. A method for finishing garment collars as a part of laundering of the garments, comprising the steps of:

(a) providing a plurality of support members that together define an axially-split support structure, (b) placing a collared garment over said plurality of support members such that the garment is supported by engagement of its collar with said support structure, (c) moving at least one of said support members in a direction away from at least one other of said support members to thereby apply a circumferentially-expansive force on the collar, and (d) heating the collar while said circumferentially-expansive force is applied to the collar.

24. A method as defined in claim 23, wherein said support structure comprises a conical support structure having a radially smaller axial end and a radially larger axial end and wherein step (c) further comprises pivoting a first one of said support members about said radially smaller axial end relative to a second one of said support members.

25. A method as defined in claim 23, further comprising the step of biasing a first one of said support members away from a second one of said support members during at least steps (c) and (d).

26. A method as defined in claim 23, wherein step (b) further comprises loading the garment onto said support structure by moving at least a first one of said support members toward at least a second one of said support members while overcoming a biasing force that urges said first support member away from said second support member.

27. A method as defined in claim 26, wherein step (b) further comprises moving said first support member toward said second support member against said biasing force by activation of a foot pedal coupled to said first support member and wherein step (c) further comprises releasing said foot pedal such that said first support member moves away from said second support member and applies a circumferentially-expansive force to the collar due to said biasing force.

* * * * *